US010273671B2

(12) United States Patent
Wisniewski et al.

(10) Patent No.: US 10,273,671 B2
(45) Date of Patent: Apr. 30, 2019

(54) DRAIN COVER

(71) Applicant: Umbra LLC, Buffalo, NY (US)

(72) Inventors: Alan Wisniewski, Stouffville (CA); Anthony Keeler, Brooklyn, NY (US)

(73) Assignee: Umbra LLC, Buffalo, NY (US)

( * ) Notice: Subject to any disclaimer, the term of this patent is extended or adjusted under 35 U.S.C. 154(b) by 221 days.

(21) Appl. No.: 15/251,730

(22) Filed: Aug. 30, 2016

(65) Prior Publication Data

US 2018/0058051 A1 Mar. 1, 2018

(51) Int. Cl.
*E03C 1/262* (2006.01)
*A47K 1/14* (2006.01)

(52) U.S. Cl.
CPC ..... *E03C 1/262* (2013.01); *A47K 1/14* (2013.01)

(58) Field of Classification Search
CPC ... E03C 1/23; E03C 1/26; E03C 1/181; E03C 1/262; E04H 4/00; E04H 4/12; A47K 1/14; A61L 9/12
USPC ..... 4/693, 293
See application file for complete search history.

(56) References Cited

U.S. PATENT DOCUMENTS 656,352 A * 8/1900 Holmes ..... A47K 1/14 4/293
4,007,500 A 2/1977 Thompson et al.
4,188,676 A * 2/1980 Tolnai ..... A47K 1/14 251/75
4,361,279 A * 11/1982 Beacham ..... A61L 9/12 239/56
4,420,844 A * 12/1983 Puckett ..... A47K 1/14 4/286
4,505,429 A * 3/1985 Mandon ..... A61L 9/12 239/56
4,908,883 A * 3/1990 Rivera ..... A47K 1/14 4/286
4,926,507 A * 5/1990 Craig ..... A47K 1/14 4/286
5,832,545 A * 11/1998 Pan ..... A47K 1/14 4/286
6,067,669 A * 5/2000 Peterson ..... E03C 1/262 4/287
6,138,290 A * 10/2000 Lin ..... E03C 1/22 4/286

(Continued)

OTHER PUBLICATIONS

OXO Tot Silicone Tub Drain Stopper; OXO Cook's Tools; Available for purchase at: ttps://www.amazon.com/OXO-Silicone-Drain-Stopper-Aqua/dp/B0038JE650/ref=cm_cr_arp_d_bdcrb_top?ie=UTF8; Published as early as Oct. 2, 2010. Last accessed Jun. 27, 2016.

(Continued)

*Primary Examiner* — Janie M Loeppke
(74) *Attorney, Agent, or Firm* — Simpson & Simpson, PLLC

(57) ABSTRACT

A drain cover including a positioning member arranged to surround an opening of a pipe of a drain and fit within the pipe, the positioning member including a plurality of openings, and a resilient sealing member connected to the positioning member at a center point, the resilient sealing member including a rim arranged concentrically about the center point. The rim contacts the positioning member to prevent fluid from passing through the plurality of openings in a closed position. The rim does not contact the positioning member to allow fluid to pass through the plurality of openings in an open position.

17 Claims, 5 Drawing Sheets

(56) References Cited

U.S. PATENT DOCUMENTS 6,418,570 B1 * 7/2002 Ball ..... A47K 1/14 4/295
6,732,385 B1 * 5/2004 Henderson ..... A47K 1/14 4/295
9,234,337 B2 * 1/2016 Ball ..... E03C 1/23
2003/0019025 A1 * 1/2003 Mullings ..... E04H 4/1236 4/507
2010/0024108 A1 * 2/2010 Yang ..... E03C 1/23 4/295
2011/0023221 A1 * 2/2011 Gibson ..... A47K 1/14 4/293
2011/0138527 A1 * 6/2011 Siena ..... A47K 1/14 4/295
2012/0090084 A1 * 4/2012 Ball ..... E03C 1/262 4/286
2013/0269100 A1 * 10/2013 Ball ..... E03C 1/23 4/693
2014/0101834 A1 * 4/2014 Ball ..... E03C 1/26 4/286
2015/0299993 A1 * 10/2015 Danhi ..... E03C 1/22 4/679
2016/0130793 A1 * 5/2016 Lesmeister ..... A47K 1/14 4/287
2016/0215485 A1 * 7/2016 Scott ..... E03C 1/262
2016/0230393 A1 * 8/2016 Huber ..... E04D 13/0409

OTHER PUBLICATIONS

Mod'n Style MK1 (6 inch) Silicone Drain Stopper and Sink Stopper for Your Kitchen, Laundry or Bath; Rebel Lace; Available for purchase at: https://www.amazon.com/Style-Silicone-Stopper-Kitchen-Laundry/dp/B00KOCA0WC; Published as early as Aug. 2, 2014. Last accessed Aug. 22, 2016.

OXO Good Grips Pop Up Drain Protector; Available for purchase at: https://www.bedbathandbeyond.com/store/product/oxo-good-grips-reg-pop-up-drain-protector/1043058815#BVRRWidgetID; Published as early as Jan. 1, 2015; Last accessed Aug. 22, 2016.

Drain stop / Hair Catcher; Umbra LLC; PowerPoint Presentation Published Oct. 23, 2014; Last accessed Nov. 9, 2016.

* cited by examiner

DRAIN COVER

FIELD

The invention broadly relates to a drain cover and, more particularly, to a drain cover which can be arranged in an open position to allow the passage of water yet prevent the passage of other materials from clogging the drain and in a closed position to plug the drain.

BACKGROUND

A typical floor drain is a plumbing fixture that is installed in a floor of a structure to remove standing water. Floor drains can be found in showers, sinks, restrooms, kitchens, refrigerator areas, locker rooms, laundry facilities, among other places. Drains can be round, square, rectangular, linear, or any suitable shape.

Drain plugs are used to prevent water from passing through drains. A drain plug can be used when a user wants to fill a bathtub, for example. Stand-alone plugs can be quickly placed and removed. For example, one tub stopper, manufactured by OXO International, Ltd. having its headquarters at 601 West 26th Street, Suite 1050, New York, N.Y., 10001, is a silicone-based stopper which merely covers a drain. The tub stopper includes an annular body and a suction cup extending outwardly from the annular body. The suction cup secures the stopper to the floor of a tub when in use and to a wall for storage when not in use. While the tub stopper can plug a drain, it cannot also be arranged to provide the functionality of a strainer. Other plugs are connected to a plumbing fixture by a chain, for example. However, such plugs can be difficult to clean and replace. Still other plugs are part of complicated drain covers which cannot be easily placed, removed, cleaned, or replaced.

Another common problem with drains is that over time they can become clogged due to the buildup of hair. A strainer is a type of perforated sieve used to strain or filter out solid debris from running water. One example strainer is a plate strainer which includes a perforated plate fixed to a drain. Water flows through the perforated plate while larger items are prevented from passing through. Another example strainer is a basket strainer which includes a perforated basket. Basket strainers are typically used in vertical systems. Some strainers are secured with screws while others can be secured using suctioning means.

An article which functions as a plug and a strainer is typically complicated and includes multiple movable components. One example bathtub stopper is described in U.S. Pat. No. 4,007,500 (Thompson et al.). The bathtub stopper is arranged to close the drain passage of a strainer cup of a bathtub and includes a main body portion which has first and second components adapted to telescope longitudinally with respect to each other between an extended position and a shortened position. The components are also rotatable with respect to one another about the longitudinal axis of the main body. The first component is manually engageable to be rotatably driven about the longitudinal axis and the second component is adapted to be secured to a strainer to locate the main body in an operative position with respect to the strainer. Unfortunately, the bathtub stopper is complex and not easy to position, remove, clean, or replace.

Therefore, there is a long-felt need for a drain cover that is easily positionable, removable, cleanable, and replaceable.

A drain cover having a single component which serves as a means for sealing and a means for removing the cover from the drain is needed.

Additionally, a simple drain cover that functions as a strainer and a plug when needed is desirable.

BRIEF SUMMARY

According to aspects illustrated herein, there is provided a drain cover including a positioning member arranged to surround an opening of a pipe of a drain and fit within the pipe, the positioning member including a plurality of openings, and a resilient sealing member connected to the positioning member at a center point, the resilient sealing member including a rim arranged concentrically about the center point.

According to aspects illustrated herein, there is provided a drain cover including a positioning member arranged to surround an opening of a pipe of a drain and fit within the pipe, the positioning member including a plurality of openings, and a resilient sealing member connected to the positioning member at a center point, the resilient sealing member including a rim arranged concentrically about the center point. The rim contacts the positioning member to prevent fluid from passing through the plurality of openings in a closed position. The rim does not contact the positioning member to allow fluid to pass through the plurality of openings in an open position.

It is a primary object to provide a simple drain cover that is easily positionable, removable, cleanable, and replaceable and can be accommodated in most drains.

It is yet another object to provide a simple drain cover that can function as a strainer and a plug.

It is another object to provide a simple drain cover including a single component which serves as a means for sealing and a means for removing the cover from the drain.

These and other objects and advantages of the present invention will be readily appreciable from the following description of preferred embodiments of the invention and from the accompanying drawings and claims.

BRIEF DESCRIPTION OF THE SEVERAL VIEWS OF THE DRAWINGS

The nature and mode of operation of the present invention will now be more fully described in the following detailed description of the invention taken with the accompanying drawing figures, in which.

DETAILED DESCRIPTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention pertains. Although any methods, devices or materials similar or equivalent to those described herein can be used in the practice or testing of the invention, the preferred methods, devices, and materials are now described.

Figure 1:
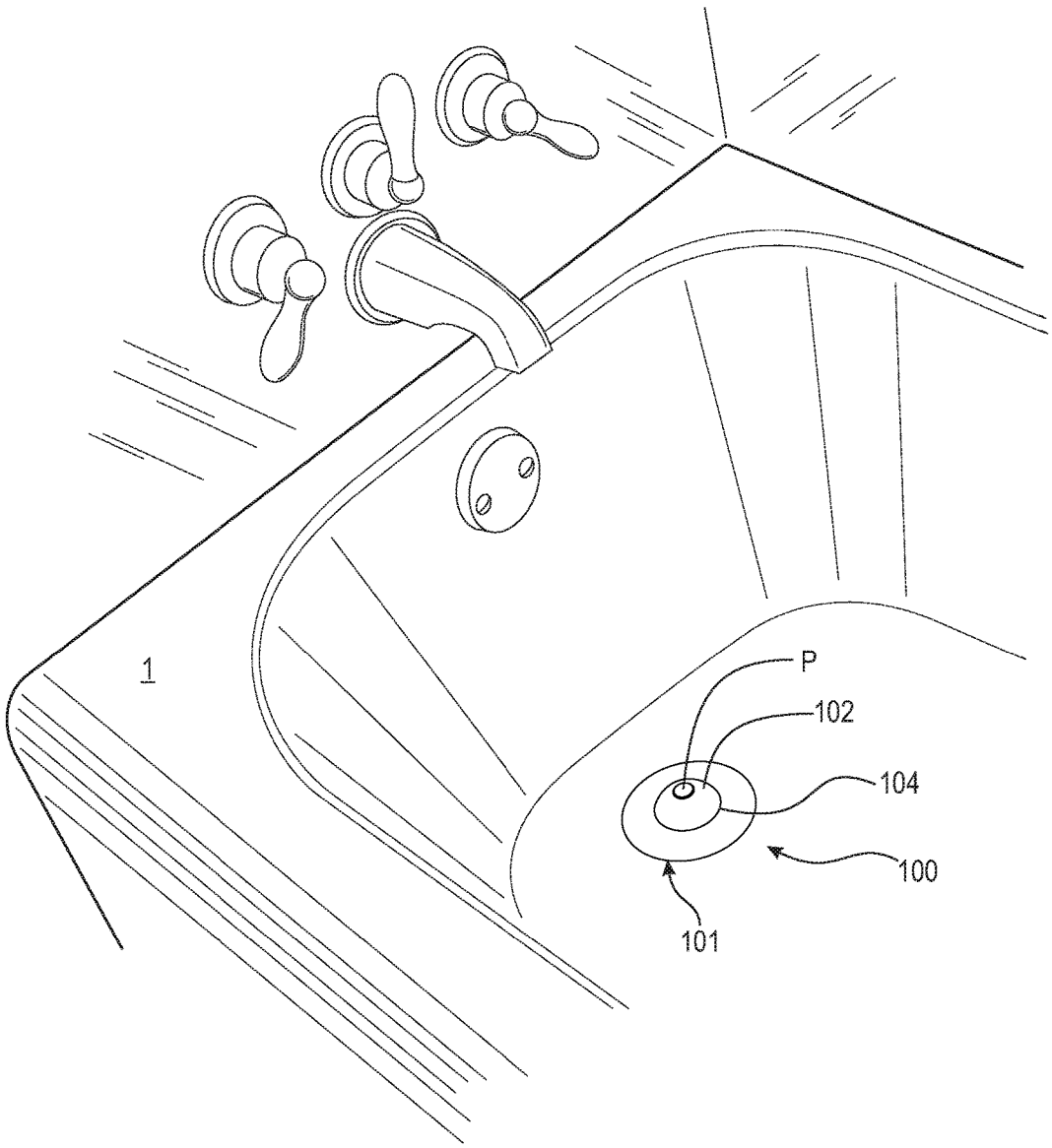
FIG. 1 is a perspective view of a drain cover positioned in a bathtub according to an example embodiment.

Adverting to the figures, FIG. 1 shows a perspective view of drain cover 100 positioned in bathtub 1 according to an example embodiment.

Figure 2A:
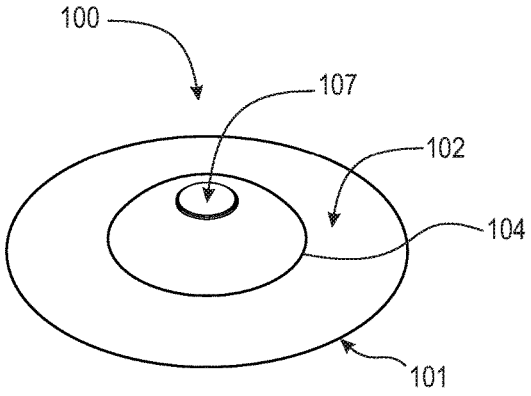
FIG. 2A is a perspective view of the drain cover shown in FIG. 1.

FIG. 2A is a perspective view of drain cover 100 shown in FIG. 1.

Figure 2B:
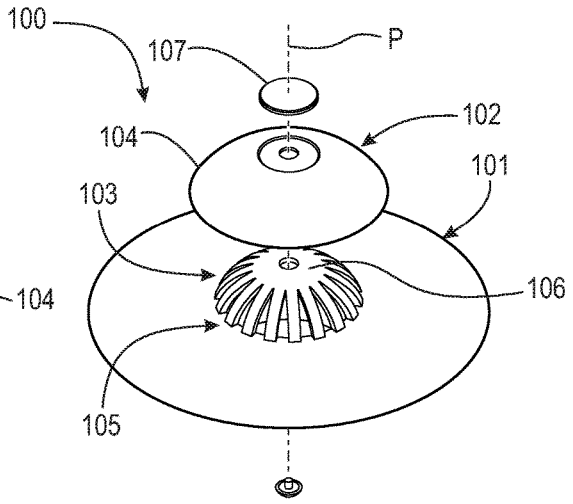
FIG. 2B is an exploded view of the drain cover shown in FIG. 2A.

FIG. 2B is an exploded view of drain cover 100 shown in FIG. 2A.

Figure 3A:
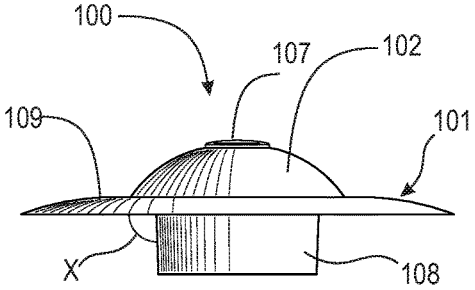
FIG. 3A is an elevational view of the drain cover shown in FIG. 2A.

FIG. 3A is an elevational view of drain cover 100 shown in FIG. 2A.

Figure 3B:
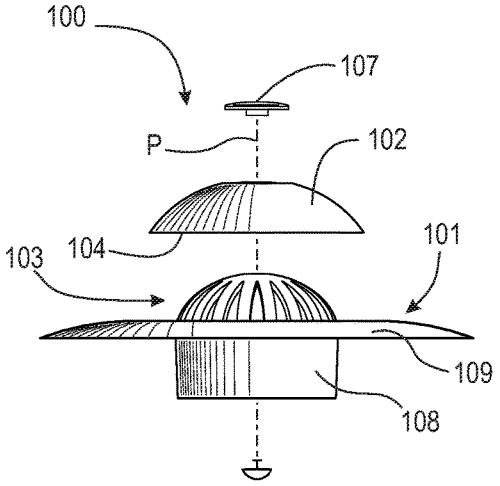
FIG. 3B is an exploded view of the drain cover shown in FIG. 3A.

FIG. 3B is an exploded view of drain cover 100 shown in FIG. 3A. The following should be viewed in light of FIGS. 1 through 3B. Drain cover 100 broadly includes positioning member 101 and resilient sealing member 102. Positioning member 101 is arranged to surround an opening of a pipe of a drain and fit within the opening of the pipe. Openings 103 are arranged in positioning member 101. Resilient sealing member 102 is connected to positioning member 101 at center point P. Resilient sealing member 102 includes rim 104 arranged concentrically about center point P. Resilient sealing member 102 is arranged to plug the drain in a closed position relative to positioning member 101 and allow the passage of water yet prevent the passage of other materials, for example, hair, from clogging the drain in an open position relative to positioning member 101.

In a closed configuration as shown in FIGS. 1 through 3B, resilient sealing member 102 includes rim 104 in contact with positioning member 101 to prevent fluid from passing through openings 103. In an open configuration (shown in FIGS. 7, 8, and 9) rim 104 does not contact positioning member 101 and fluid is allowed to pass through openings 103. Drain cover 100 is either in an open position or a closed position. Resilient sealing member 102 is flexible between the open and closed positions as discussed further below.

Openings 103 are arranged in dome-shaped portion 105 of positioning member 101. Dome-shaped portion 105 includes solid portion 106 which provides a seat upon which resilient sealing member 102 can rest. In an example embodiment, solid portion 106 is planar. In an example embodiment, solid portion 106 includes a curvature which matches the curvature of the underside surface of resilient sealing member 102.

Fastener 107 is provided to secure resilient sealing member 102 with dome-shaped portion 105 of positioning member 101. In an example embodiment, fastener 107 is intended to remain fastened at all times after manufacturing. Fastener 107 can be a rivet or any suitable alternative. In an example embodiment, fastener 107 can be removed by the user so that resilient sealing member 102 is removable from positioning member 101.

Positioning member 101 includes cylindrical portion 108, arranged to fit within a pipe, and annular member 109. Cylindrical portion 108 extends downwardly from annular portion 109. Angle X is formed between cylindrical portion 108 and annular portion 109. In an example embodiment, angle X is 90 degrees. In an example embodiment, angle X is larger than 90 degrees.

Dome-shaped portion 105 is taller than annular portion 109. The outer diameter of rim 104 is larger than the outer diameter of dome-shaped portion 105. In an example embodiment, openings 103 are smaller circumferentially proximate solid portion 106 and larger circumferentially proximate annular portion 109. Openings 103 form a point proximate solid portion 106. Each opening 103 is equidistant from the next adjacent opening 103 in a circumferential direction about center point P. Although a particular number and arrangement of openings is illustrated, drain cover 100 is not so limited. For example, openings 103 can be arranged at angles at 90, 180, 270, and 360 degrees. Alternatively, a plurality of openings can be arranged about half of dome-shaped portion 105 and the rest of dome-shaped portion 105 can be solid, or, formed including a single opening.

Figure 4A:
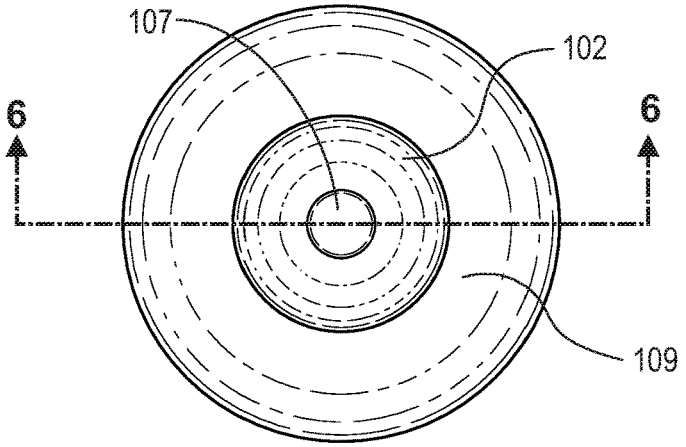
FIG. 4A is a top view of the drain cover shown in FIG. 1 in a closed configuration.

FIG. 4A is a top view of drain cover 100 shown in FIG. 1, in a closed configuration. Annular portion 109, resilient sealing member 102, and fastener 107 are concentric. Rim 104 is not visible because it is contacting annular portion 109. In the example embodiment shown, resilient sealing member 102 and fastener 107 are annular like annular portion 109. However, other shapes are contemplated. Resilient sealing member 102 is arcuate from fastener 107 to rim 104.

Figure 4B:
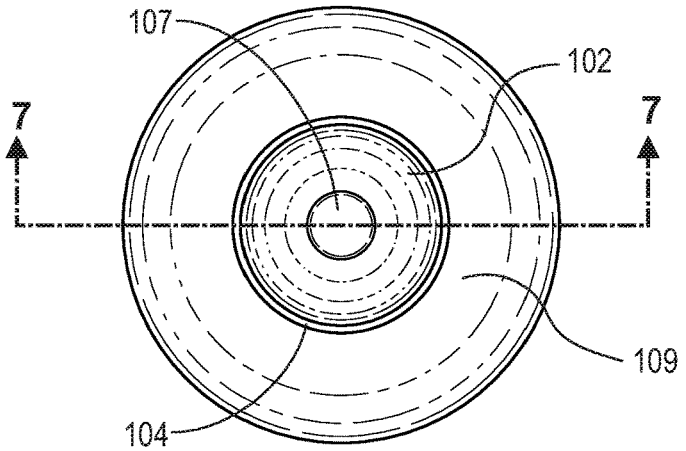
FIG. 4B is a top view of the drain cover shown in FIG. 1 in an open configuration.

FIG. 4B is a top view of drain cover 100 shown in FIG. 1, in an open configuration. Annular portion 109, resilient sealing member 102, and fastener 107 are concentric. Rim 104 is visible. In an example embodiment, rim 104 is not visible in an open configuration and, instead, is visible from a side view only.

Figure 5:
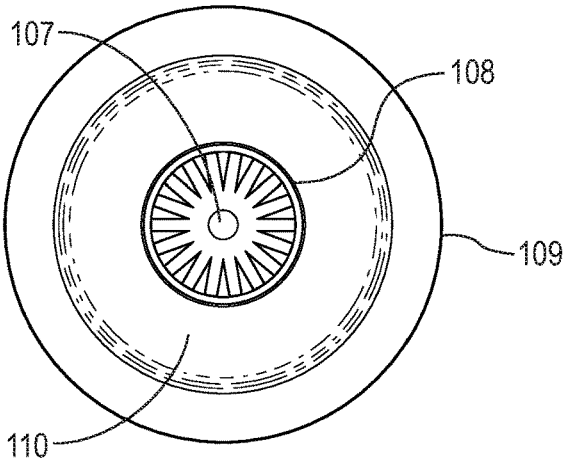
FIG. 5 is a bottom view of the drain cover shown in FIG. 1.

FIG. 5 is a bottom view of drain cover 100 shown in FIG. 1. A planar circumferential surface extends inward from the outer diameter of annular member 109 toward cylindrical member 108. An arcuate circumferential surface extends from cylindrical member 108 to the planar surface. In an example embodiment, the arcuate circumferential surface is recess 110. In FIG. 5, the planar circumferential surface surrounds recess 110. The planar circumferential surface and recess 110 are concentric with cylindrical member 108. The bottom surfaces of drain cover 100 maximize water pressure when in use to provide a seal with the surface surrounding the drain whether the surface is flat or curved.

Figure 6:
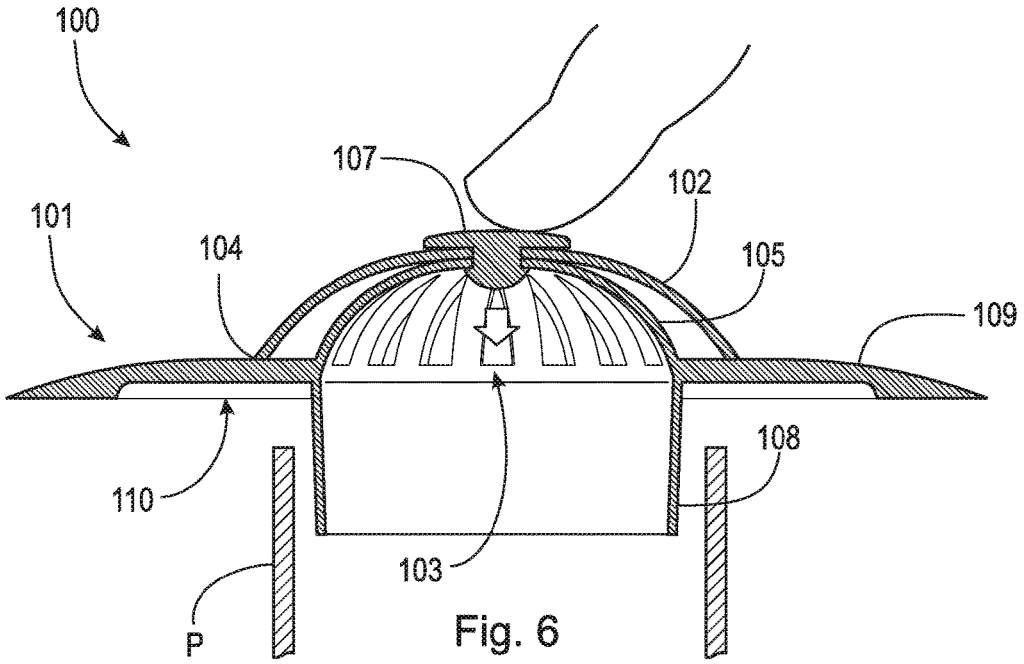
FIG. 6 is a cross-sectional view of the drain cover, taken generally along line 6-6 in FIG. 4A.

FIG. 6 is a cross-sectional view of drain cover 100, taken generally along line 6-6 in FIG. 4A.

Figure 7:
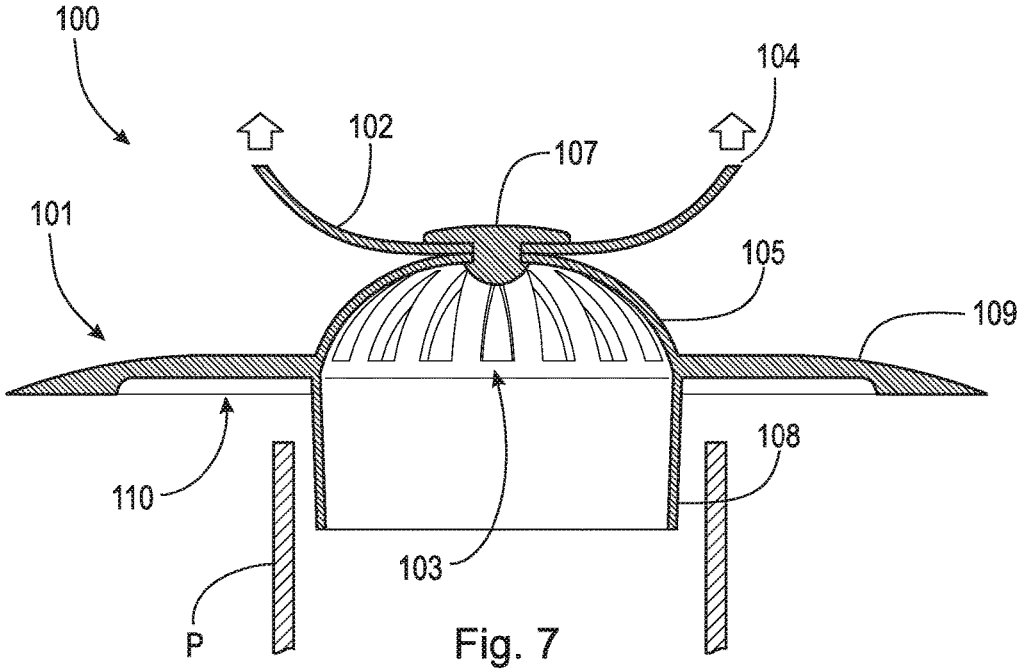
FIG. 7 is a cross-sectional view of the drain cover, taken generally along line 7-7 in FIG. 4B.

FIG. 7 is a cross-sectional view of drain cover 100, taken generally along line 7-7 in FIG. 4B. The following should be viewed in light of FIGS. 6 and 7. In the closed configuration illustrated in FIG. 6, resilient sealing member 102 covers openings 103 in dome-shaped portion 105. In the closed configuration, resilient sealing member 102 forms a first angle relative to positioning member 101. In the open configuration illustrated in FIG. 7, resilient sealing member 102 does not cover openings 103 in dome-shaped portion 105. In the open configuration, resilient sealing member 102 forms a second angle relative to positioning member 101 where the second angle is larger than the first angle. To transition from the closed configuration to the open configuration, a user presses downwardly on top of fastener 107 in the direction shown. As fastener 107 is depressed downwardly, dome-shaped portion 105 is also depressed downwardly. Once fastener is fully pressed, rim 104 is urged upwardly and resilient sealing member 102 is urged into the open configuration.

In the open configuration, rim 104 can be facing upwardly in the direction shown in FIG. 7 or outwardly. In the open configuration when rim 104 is arranged to face outwardly toward the sides of the page, resilient sealing member 102 is s-shaped.

In the open configuration, drain cover 100 can be removed from a drain using resilient sealing member 102 which is extending upwardly. For example, a user can grab resilient sealing member 102 when it is extending upwardly in the open configuration and pull upwardly and drain cover 100 is lifted up and out of the drain. When drain cover 100 is not in place in a drain it can be easily stored, cleaned, or replaced.

To transition from the open configuration to the closed configuration, a user can press downwardly on rim 104 or the outer edge of resilient sealing member 102 to contact annular member 109. As rim 104 is urged downwardly, fastener 107 and dome-shaped portion 105 remain upright.

In an example embodiment, drain cover 100 is approximately 4 inches in diameter and approximately 1 inch tall from the bottom edge of cylindrical portion 108 to the top of fastener 107 in the closed position. In an open position, drain cover 100 is approximately 1.4 inches tall. In an example embodiment, resilient sealing member 102 is approximately 2 inches in diameter in the closed and open configurations. In an example embodiment, dome-shaped portion 105 is approximately 1.5 inches. In an example embodiment, drain cover 100 is 4×4×1 in (10.2×10.2×2.5 cm).

Drain cover 100 can be made of silicone or any other suitable soft and flexible materials, for example, rubber. Fastener 107 is made of a light, rigid metal, for example stainless steel.

Figure 8:
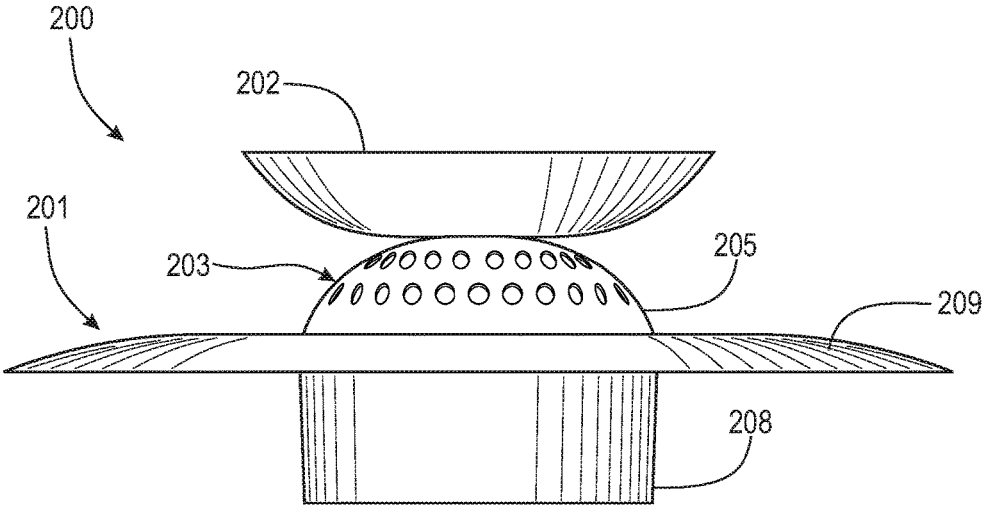
FIG. 8 is an elevational view of an alternate embodiment of the drain cover shown in FIG. 1, in an open configuration; and, FIG. 9 is an elevational view of an alternate embodiment of the drain cover shown in FIG. 1, in an open configuration.

FIG. 8 is an elevational view of an alternate embodiment of the drain cover shown in FIG. 1, in an open configuration. The discussion pertaining to drain cover 100 applies to drain cover 200 except as noted here. Drain cover 200 includes openings 203 in dome-shaped portion 205. Openings 203 are circular in an example embodiment. In an example embodiment, drain cover 200 includes two rows of openings 203. In an example embodiment, a first row of openings 203 is positioned circumferentially and radially half way between fastener 207 and annular member 109. In an example embodiment, in addition to the first row of openings, a second row of openings is arranged between the first row and fastener 207. In an example embodiment, openings 203 are arranged equidistant circumferentially. Drain cover 200 is not limited to the number and arrangement of openings 203 illustrated. For example, additional or fewer openings are contemplated and larger or smaller openings are contemplated as well. Additionally, the shape of the openings can vary.

Figure 9:
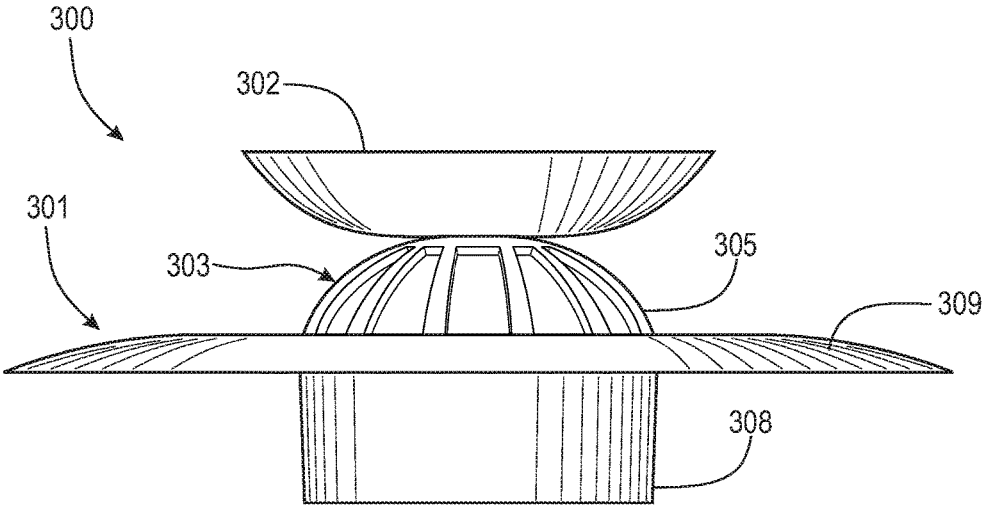

FIG. 9 is an elevational view of an alternate embodiment of the drain cover shown in FIG. 1, in an open configuration. The discussions pertaining to drain covers 100, 200 apply to drain cover 300 except as noted here. Drain cover 300 includes openings 303 in dome-shaped portion 305. Like openings 103, openings 303 are smaller circumferentially proximate fastener 307 as compared with the parts of openings 303 proximate annular member 309. Unlike openings 103 which form a point proximate fastener 107, openings 303 include a planar edge proximate fastener 307 and another planar edge proximate annular member 309.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A drain cover, comprising:

a positioning member arranged to surround an opening of a pipe of a drain and fit within the pipe, the positioning member further comprising:

a plurality of openings;

an annular portion arranged to surround the opening of the pipe; and, a cylindrical portion arranged to fit within the pipe, the cylindrical portion connected to the annular portion forming an angle therebetween, the cylindrical portion extending below the annular portion and; and, a resilient sealing member connected to the positioning member at a center point, the resilient sealing member further including a rim arranged concentrically about the center point, the resilient sealing member extending above the annular portion.

2. The drain cover of claim 1, wherein the rim contacts the positioning member to prevent fluid from passing through the plurality of openings in a closed position.

3. The drain cover of claim 1, wherein the rim does not contact the positioning member to allow fluid to pass through the plurality of openings in an open position.

4. The drain cover of claim 1, wherein the angle is 90 degrees.

5. The drain cover of claim 1, wherein the positioning member further comprises an annular portion and a dome-shaped portion arranged concentrically within the annular portion and the dome-shaped portion includes the plurality of openings.

6. The drain cover of claim 1, wherein the positioning member and the resilient sealing member are integral.

7. The drain cover of claim 1, wherein the resilient sealing member forms a first angle relative to the positioning member in a closed position.

8. The drain cover of claim 7, wherein the resilient sealing member forms a second angle, different than the first angle, relative to the positioning member in an open position.

9. The drain cover of claim 8, wherein the second angle is larger than the first angle.

10. A drain cover, comprising:

a positioning member arranged to surround an opening of a pipe of a drain and fit within the pipe, the positioning member further comprising:

a plurality of openings;

an annular portion arranged to surround the opening of the pipe; and, a cylindrical portion arranged to fit within the pipe, the cylindrical portion connected to the annular portion forming an angle therebetween, the cylindrical portion extending below the annular portion and; and, a resilient sealing member connected to the positioning member at a center point, the resilient sealing member further including a rim arranged concentrically about the center point, the resilient sealing member extending above the annular portion;

wherein the rim contacts the positioning member to prevent fluid from passing through the plurality of openings in a closed position; and, wherein the rim does not contact the positioning member to allow fluid to pass through the plurality of openings in an open position.

11. The drain cover of claim 10, wherein the plurality of openings includes at least one circular opening.

12. The drain cover of claim 10, wherein the plurality of openings includes at least one slotted opening.

13. The drain cover of claim 10, wherein the plurality of openings includes at least one tapered slotted opening.

14. The drain cover of claim 10, wherein the positioning member further comprises:

an annular portion; and, a dome-shaped portion arranged concentrically within the annular portion, the dome-shaped portion including the plurality of openings.

15. The drain cover of claim 10, wherein the resilient sealing member forms a first angle relative to the positioning member in a closed position.

16. The drain cover of claim 15, wherein the resilient sealing member forms a second angle, different than the first angle, relative to the positioning member in an open position.

17. The drain cover of claim 16, wherein the second angle is larger than the first angle.

* * * * *